US011841185B2

(12) United States Patent
Lee et al.

(10) Patent No.: US 11,841,185 B2
(45) Date of Patent: Dec. 12, 2023

(54) STORAGE BOX FOR REFRIGERATOR AT ENTRANCE

(71) Applicant: LG ELECTRONICS INC., Seoul (KR)

(72) Inventors: Seojin Lee, Seoul (KR); Insun Yeo, Seoul (KR); Minseok Kim, Seoul (KR); Eugene Myung, Seoul (KR); Deukwon Lee, Seoul (KR); Miyoung Seo, Seoul (KR); Wonjin Lee, Seoul (KR); Kyukwan Choi, Seoul (KR); Minkyu Oh, Seoul (KR); Yezo Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 223 days.

(21) Appl. No.: 17/433,570

(22) PCT Filed: Feb. 13, 2020

(86) PCT No.: PCT/KR2020/002081
§ 371 (c)(1),
(2) Date: Aug. 24, 2021

(87) PCT Pub. No.: WO2020/175835
PCT Pub. Date: Sep. 3, 2020

(65) Prior Publication Data

US 2022/0120491 A1 Apr. 21, 2022

(30) Foreign Application Priority Data

Feb. 25, 2019 (KR) ..... 10-2019-0021867
Jun. 3, 2019 (KR) ..... 10-2019-0065626

(51) Int. Cl.
*F25D 23/06* (2006.01)
*F25D 23/10* (2006.01)
(Continued)

(52) U.S. Cl.
CPC ..... *F25D 23/063* (2013.01); *B65D 21/0213* (2013.01); *B65D 21/086* (2013.01);
(Continued)

(58) Field of Classification Search
CPC ..... F25D 23/063; F25D 23/065; F25D 23/10; F25D 25/005; B65D 21/0213;
(Continued)

(56) References Cited

U.S. PATENT DOCUMENTS 3,577,673 A * 5/1971 Monestier ..... A63H 33/103 446/490
10,279,956 B1 * 5/2019 Gamboa ..... B65D 21/086
(Continued)

FOREIGN PATENT DOCUMENTS

CN 107922078 A 4/2018
CN 106742548 B 7/2018
(Continued)

*Primary Examiner* — Andrew D Perreault
(74) *Attorney, Agent, or Firm* — Bryan Cave Leighton Paisner LLP

(57) ABSTRACT

A storage box for a refrigerator at an entrance according to an embodiment of the present invention, may comprise: a base; first side walls erected at the top front end and the top rear end of the base, respectively; and second side walls erected at the top left end and the top right end of the base, respectively, wherein the first side wall may include a plurality of first blocks stacked in the vertical direction and arranged in the horizontal direction, and a plurality of connectors movably connecting the adjacent first blocks in the horizontal direction.

22 Claims, 10 Drawing Sheets

(51) Int. Cl.
*F25D 25/00* (2006.01)
*B65D 21/08* (2006.01)
*B65D 21/02* (2006.01)

(52) U.S. Cl.
CPC ..... *F25D 23/065* (2013.01); *F25D 23/10* (2013.01); *F25D 25/005* (2013.01); *B65D 2203/06* (2013.01); *B65D 2313/04* (2013.01)

(58) Field of Classification Search
CPC ..... B65D 21/086; B65D 2203/06; B65D 2313/04; B65D 21/083; B65D 21/08; B65D 11/1873; A63H 33/103; A63H 33/107; A63H 33/04; A63H 33/044
USPC ..... 220/8
See application file for complete search history.

(56) References Cited

U.S. PATENT DOCUMENTS

2002/0121520 A1* 9/2002 Govrik ..... B65D 1/36 220/500
2008/0251513 A1* 10/2008 Vatn ..... B65D 21/086 220/8
2013/0206411 A1* 8/2013 Zhang ..... B65D 88/32 175/57
2013/0206753 A1* 8/2013 Zhang ..... B65D 90/205 220/9.2
2014/0225487 A1 8/2014 Yang
2015/0151876 A1* 6/2015 Lutter ..... B65D 9/22 220/6
2016/0353707 A1 12/2016 Linan et al.
2018/0201404 A1 7/2018 Lam et al.

FOREIGN PATENT DOCUMENTS

CN 108284999 A 7/2018
GB 2293594 A 4/1996
JP 10-236426 A 9/1998
KR 10-2011-0033394 A 3/2011
KR 10-1632535 B1 6/2016
KR 10-2017-0039826 A 4/2017
KR 10-2018-0064761 A 6/2018
KR 10-2018-0115117 A 10/2018
WO 97/41542 A1 11/1997

* cited by examiner

STORAGE BOX FOR REFRIGERATOR AT ENTRANCE

This application is a National Stage Application of International Application No. PCT/KR2020/002081, filed on Feb. 13, 2020, which claims the benefit of and priority to Korean Application No. 10-2019-0021867, filed on Feb. 25, 2019 and Korean Application No. 10-2019-0065626, filed on Jun. 3, 2019, which are hereby incorporated by reference in their entirety for all purposes as if fully set forth herein.

TECHNICAL FIELD

The present invention relates to a storage box for refrigerator at an entrance.

BACKGROUND ART

Recently, a delivery service for delivering articles to a predetermined place has been activated. Particularly, when the article is fresh food, a refrigerator or a heating cabinet is provided in the delivery vehicle to prevent the food from being spoiling or getting cold so that the food is stored and delivered.

It is common that food is generally delivered in packaging to be maintained in a cooled or warm state. The packaging material is made of environmental pollutants such as Styrofoam, thereby creating a social atmosphere to reduce usage.

If the user is at home at the delivery time, the delivery person and the user may face-to-face to receive food, but when the user is not at home or when the delivery time is too early or too late, it is difficult for the delivery person and the user to face-to-face to receive the food.

Therefore, even if the delivery person and the user do not directly face each other, the food may be delivered, and there is a need to not spoil or cool the food until it is finally delivered to the user.

In order to solve this problem, recently, the refrigerator is installed at the entrance (front door) at a predetermined place, so that the delivery person keeps the food in the refrigerator to keep the food in a fresh state, and the user may access the refrigerator at a convenient time to receive the food.

In the prior art below, an entrance refrigerator mounted on an entrance door is disclosed.

Prior Art: Korean Patent Publication No. 2011-0033394 (Mar. 31, 2011)

DISCLOSURE OF THE INVENTION

Technical Problem

In the entrance refrigerator disclosed in the prior art, a separate storage box is not provided in a food storage space. That is, the storage box that is capable of being accommodated in or withdrawn from the storage space of the entrance refrigerator is not disclosed.

In addition, most of the storage boxes of the typical refrigerators are single-type storage boxes that are not capable of being adjusted in size. However, since a product ordered by a consumer through an on-line market vary in volume and shape depending on the type thereof, it is required to be able to adjust a size of a storage box to sufficiently accommodate the product.

Technical Solution

A storage box for a refrigerator at an entrance according to an embodiment of the present invention for achieving the above object includes: a base; a first sidewall erected at each of a front end and a rear end of a top surface of the base; and a second sidewall erected at each of a left end and a right end of the top surface of the base, wherein the first sidewall includes: a plurality blocks stacked in a vertical direction and arranged in a horizontal direction; and a plurality of connectors configured to movably connect the first blocks, which are adjacent to each other in the horizontal direction, to each other.

Advantageous Effects

According to the storage box for the entrance refrigerator according to the embodiment of the present invention having the above configuration, the width and height of the storage box may be adjusted according to the size of the ordered product, and thus, the articles having various shapes and sizes may be flexibly accommodated.

In addition, when the large number of articles are ordered at one time, there may be the advantage that the storage box itself is carried to move, and it may be easy to move the article from the entrance refrigerator to the kitchen refrigerator.

Also, since the bottom portion of the storage box is detachable separately, the bottom portion of the storage box may be removed in the state in which the storage box is placed on the shelf of the kitchen refrigerator, and then the wall portion may be left, so there is no need to move the articles one by one.

MODE FOR CARRYING OUT THE INVENTION

Hereinafter, a storage box of an entrance refrigerator according to an embodiment of the present invention will be described in with reference to the accompanying drawings.

In this specification, an entrance refrigerator or a refrigerator for an entrance is used interchangeably, but they all have the same meaning, that is, a refrigerator mounted on a door or a wall of the entrance should be interpreted the same.

Figure 1:
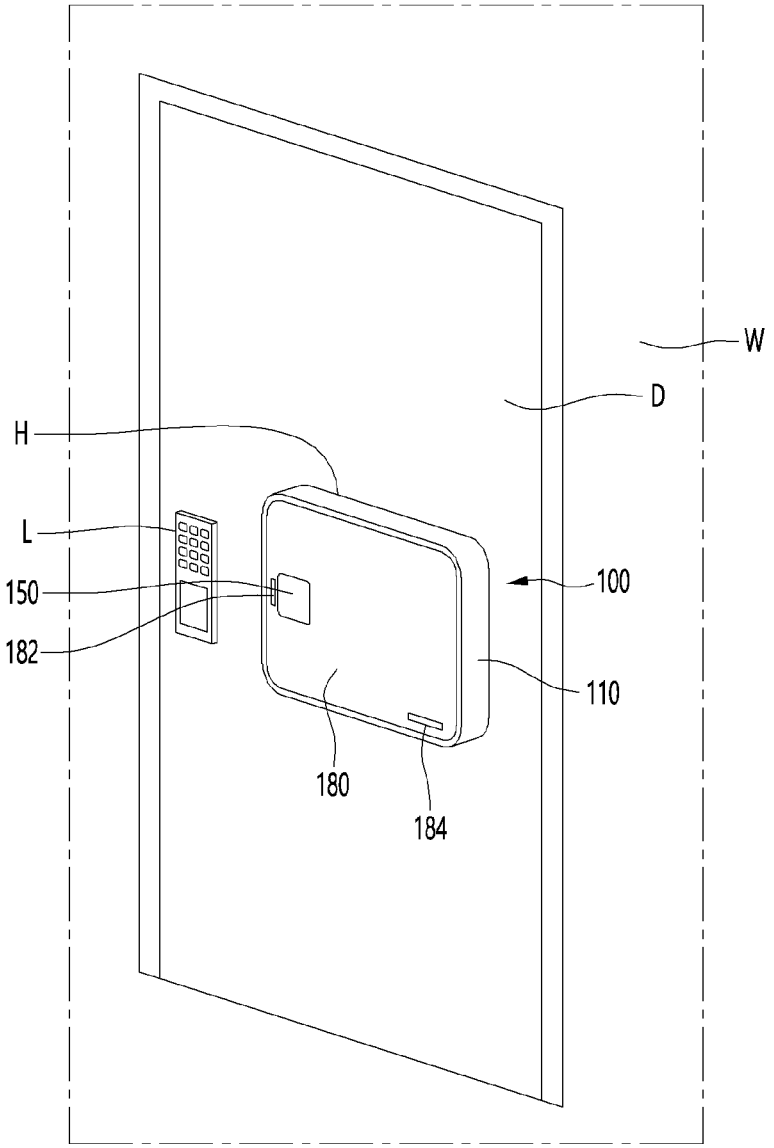
FIG. 1 is a view illustrating a state in which an entrance refrigerator is installed on an entrance door according to an embodiment of the present invention.
Figure 2:
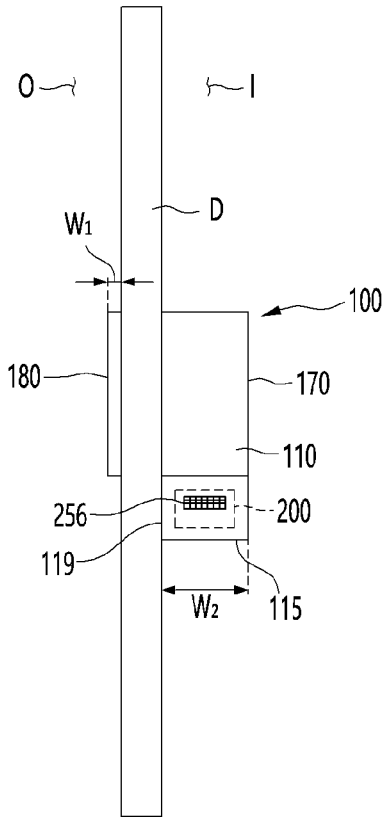
FIG. 2 is a side view illustrating configurations of an indoor-side and an outdoor-side based on the door in the state in which the entrance refrigerator is installed on the entrance door.
Figure 3:
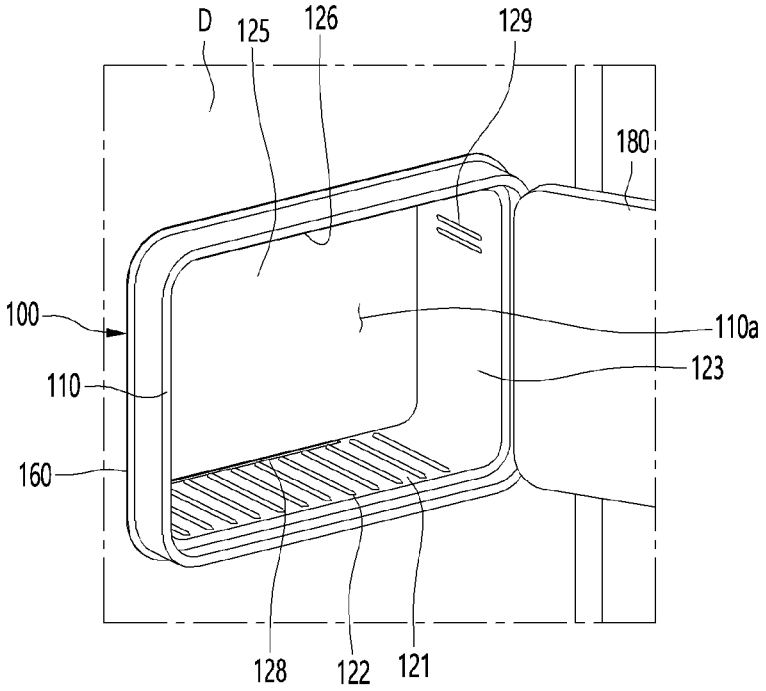
FIG. 3 is a perspective view illustrating the inside of a storage compartment of the entrance refrigerator.

FIG. 1 is a view illustrating a state in which an entrance refrigerator is installed on an entrance door according to an embodiment of the present invention, FIG. 2 is a side view illustrating configurations of an indoor-side and an outdoor-side based on the door in the state in which the entrance refrigerator is installed on the entrance door, and FIG. 3 is a perspective view illustrating the inside of a storage compartment of the entrance refrigerator.

Referring to FIGS. 1 to 3, an entrance refrigerator 100 according to an embodiment of the present invention may be installed at an entrance door D of a home or office. The entrance door D is installed on a wall W. A door lock L for opening the door D may be provided.

An opening H is formed in the entrance door D, and the entrance refrigerator 100 may be inserted into the opening H to extend to an indoor-side I and an outdoor-side O. The direction will be defined. With respect to the entrance refrigerator 100, the outdoor-side O is defined as a "front side" and the indoor-side I is defined as a "rear side".

The entrance refrigerator 100 includes a cabinet 110 that forms an outer appearance thereof.

For example, the cabinet 110 may have a substantially rectangular parallelepiped shape and be disposed to pass through the opening H. A sealer 160 is provided between the opening H and an outer surface of the cabinet 110 so that the cabinet 110 is in close contact with the opening H.

A storage compartment 110*a* capable of storing food is formed inside the cabinet 110. A camera (not shown) may be provided on a top surface, that is, a ceiling, of a storage compartment 110*a*. The camera 118 may photograph the food stored in the storage compartment 110*a* and upload the captured image to a delivery application.

For this, the entrance refrigerator may be provided with a communication module capable of communicating with the outside. For example, the communication module may include a Wi-Fi device.

The storage compartment 110*a* may be opened at the indoor-side I and the outdoor-side O.

In detail, the entrance refrigerator 100 may be provided at one side (outside) of the storage compartment 110*a* and may further include an outdoor-side door 180 capable of opening or closing the storage compartment 110*a*. The outdoor-side door 180 may be disposed at the outdoor-side O and may be, for example, a door opened by a food delivery person in order to put the food therein. The outdoor-side door 180 may be in a normally locked state to prevent an opening of any door.

The entrance refrigerator 100 may be provided at the other side (indoor-side) of the storage compartment 110*a* and further include an indoor-side door 170 capable of opening or closing the storage compartment 110*a*. The indoor-side door 170 may be disposed at the indoor-side (I) and may be a door opened by a user in order to collect food.

The outdoor-side door 180 and the indoor-side door 170 may be rotatably coupled to the cabinet 110.

A code scanner 184 capable of reading information on delivered food may be provided on a front surface of the outdoor-side door 180. The code scanner 184 may include a barcode scanner or a QR code scanner.

When a food delivery person brings food information (code information) provided on food or a food container to the code scanner 184, the entrance refrigerator 100 recognizes that the food is scheduled to be delivered and release the locked state of the outdoor-side door 180. In this state, the delivery person may open the outdoor-side door 180 to store the food.

A display portion 150 may be provided on the outdoor-side door 180. Information that is necessary for use of the entrance refrigerator 100 is displayed on the display portion 150.

For example, the display portion 150 may display a "guide comment" for the delivery person. For example, the guide comment may include a comment such as "Please recognize barcode or QR code of food to code scanner".

An input portion for inputting a password or an authentication number may be displayed on the display portion 150. The delivery person may release the lock state of the outdoor-side door 180 by inputting the password promised in advance with the user into the input portion.

In summary, the delivery person allows the food code to be recognized to the code scanner 184 or inputs a password or authentication number to unlock the outdoor-side door 180, and thus, after opening the outdoor-side door 180, the food is stored in the storage compartment 110*a*.

The cabinet 110 may extend toward the indoor-side I and the outdoor-side O through the door D. A front-rear width W2 of a portion of the cabinet 110, which extends toward the indoor-side I, may be greater than a front-rear width W1 of a portion, which extends toward the outdoor-side O.

According to such a configuration, since an area protruding from the door D toward the indoor-side I is large, and an area protruding from the door D toward the outdoor-side O is small, an area of the entrance refrigerator 100, which is exposed to a space through which arbitrary people pass, may be reduced. Thus, possibility of damage to the entrance refrigerator 100 may be reduced.

A front support portion 119 supported on an outer surface of the door D is formed on a lower portion of the cabinet 110 extending toward the indoor-side I. For example, the front support portion 119 may be attached to a rear surface of the door D.

A cold air supply device 200 may be provided at the lower portion of the entrance refrigerator 100. Since a front surface portion of a portion in which the relatively heavy cold air supply device 200 is accommodated, that is, the front support portion 119 is supported or attached to the door D, the entrance refrigerator 100 may be stably mounted on the door D.

An indoor air suction hole (not shown) may be formed in the bottom surface 115 of the cabinet 110, and an indoor air discharge hole 256 for discharging indoor space suctioned into the indoor air suction hole to the indoor space again may be formed in each of both side surface portions of the cabinet 110.

The formation positions of the indoor air suction hole and the indoor air discharge hole 256 are not limited to this embodiment and may be formed at appropriate positions according to design conditions.

The storage compartment 110*a* may be defined by an inner wall of the cabinet 110. In detail, the inner wall of the cabinet 110 includes a storage compartment lower wall 121 forming a seating surface on which food is placed, a storage compartment sidewall 123 extending upward from both sides of the storage compartment lower wall 121, a storage compartment upper wall 126 forming a top surface of the storage compartment 110*a* and connecting an upper portion of the storage compartment sidewall 123, and a storage compartment rear wall 125 connecting a rear portion of the storage compartment sidewall 123.

The storage compartment lower wall 121 may be provided with a rib 122 protruding upward, and the rib 122 may extend forward and backward and be provided in plurality, which are arranged in left and right directions. Food is placed at an upper side of the plurality of ribs 122 to prevent the food from being slid.

A cold air inflow hole 128 for allowing the cold air inside the storage compartment 110*a* to return to the cold air supply device 200 is formed in the storage compartment lower wall 121. For example, the cold air inflow hole 128 may be formed at a rear side of the storage compartment lower wall 121, but is not limited thereto.

A cold air discharge hole 129 for supplying the cold air generated by the cold air supply device 200 to a side of the storage compartment 110*a* is formed in the storage compartment sidewall 123. The cold air generated in the cold air supply device 200 may be supplied to the side surface portion of the storage compartment 110*a* by the configurations of the cold air inflow hole 128 and the cold air discharge hole 129, and then be returned to the cold air supply device 200 through a rear lower portion. The formation position of the cold air discharge hole is not limited to this embodiment and may be formed at an appropriate position according to design conditions.

The cold air supply device 200 according to an embodiment of the present invention may include a thermoelectric module.

The cold air supply device 200 includes a thermoelectric element having a heat absorption surface and a heat generation surface, a cold sink attached to the heat absorption surface, a heat sink attached to the heat generation surface, a cooling fan disposed in front of the cold sink, and a heat dissipation fan disposed behind the heat sink.

In detail, when the cooling fan is driven, air inside the storage compartment 110*a* is suctioned into the cold sink through the cold air suction hole, cooled to a low temperature, and then discharged again to the cold air discharge hole 129.

When the heat dissipation fan is driven, air is suctioned into the heat sink through the indoor air suction hole to absorb heat, and then is discharged again into the indoor space through the indoor air discharge hole 256.

The storage box according to an embodiment of the present invention may be accommodated in the storage compartment 110*a*.

Figure 4:
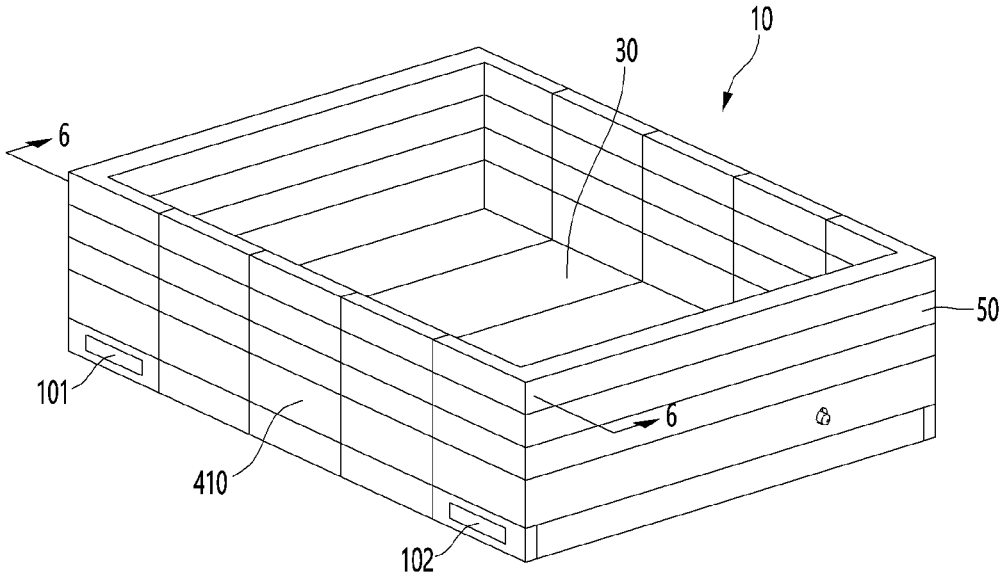
FIG. 4 is a perspective view illustrating a storage box accommodated in the entrance refrigerator according to an embodiment of the present invention.

FIG. 4 is a perspective view illustrating the storage box accommodated in the entrance refrigerator according to an embodiment of the present invention.

Referring to FIG. 4, a storage box 10 for an entrance refrigerator according to an embodiment of the present invention includes a base 30 forming a bottom portion on which an article is placed, and a pair of first sidewalls 40 and a pair of second sidewalls 50, which extend upward from an edge of the base 30.

The pair of first sidewalls 40 may be understood as walls defining front and rear surfaces of the basket 10, and the pair of second sidewalls 40 may be understood as walls defining left and right surfaces of the basket.

An order information code 101 and a temperature display portion 102 may be formed on the front surface of any one of the pair of first sidewalls 40.

The order information code 101 may include a QR code or RF-ID tag containing information about an article ordered by a consumer. That is, when a delivery person who delivers goods brings the order information code 101 to a code scanner 184, a locking state of the outdoor-side door 180 is released. Alternatively, when the order information code 101 approaches a recognition range of the code scanner 184, the code scanner 184 may automatically recognize to unlock the outdoor-side door 180.

The base 30 is configured to have a variable width in the left and right directions, and at least one of the first sidewalls 40 and the second sidewalls 50 has a variable width in the left and right directions and a height in a vertical direction.

Particularly, when the width of each of the first sidewalls 40 varies in the left and right directions, the width of the base 30 also varies in the left and right directions.

Hereinafter, the structure having the variable width and height of the storage box 10 will be described with reference to the drawings.

Figure 5:
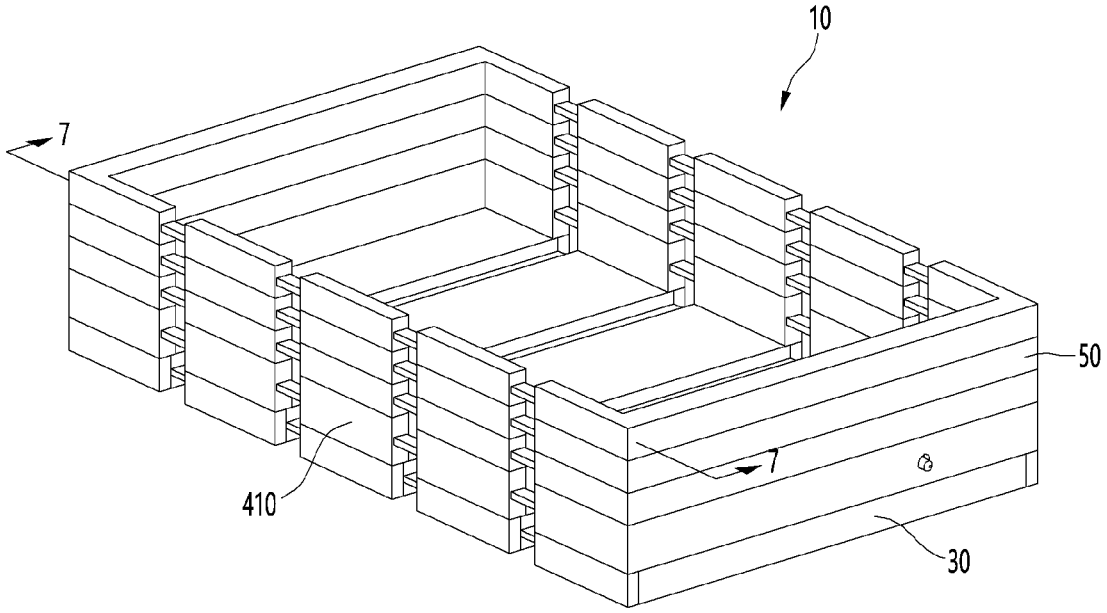
FIG. 5 is a perspective view of a storage box in a state in which widths of a base and a first sidewall increase.
Figure 6:
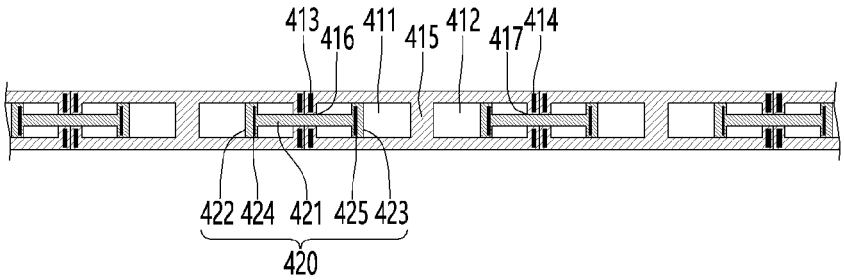
FIG. 6 is a longitudinal cross-sectional view of a first sidewall, taken along line 6-6 of FIG. 4.
Figure 7:
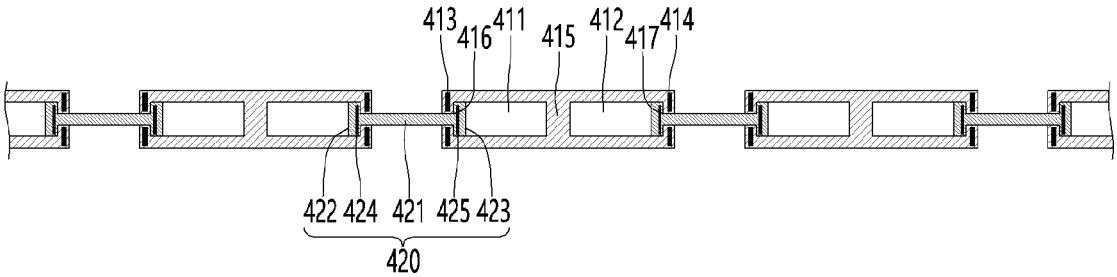
FIG. 7 is a longitudinal cross-sectional view of a first sidewall, taken along line 7-7 of FIG. 5.

FIG. 5 is a perspective view of the storage box in a state in which the widths of the base and the first sidewall increase, FIG. 6 is a longitudinal cross-sectional view of the first sidewall, taken along line 6-6 of FIG. 4, and FIG. 7 is a longitudinal cross-sectional view of the first sidewall, taken along line 7-7 of FIG. 5.

In detail, the cross-sectional view illustrated in FIG. 6 is a cross-sectional view in a state before the width of the first side wall 40 varies, and the cross-sectional view illustrated in FIG. 7 is a cross-sectional view in a state in which the width of the first side wall 40 varies in a direction in which the width increases.

First, a structure in which the width of the first sidewall 40 is variable will be described.

Referring to FIGS. 5 to 7, in the first sidewall 40 according to an embodiment of the present invention, a plurality of blocks 410 are stacked vertically, and the plurality of blocks are disposed in the left and right directions. The plurality of blocks disposed in the left and right directions are movably connected by a plurality of connectors 420. The block 410 may be defined as a first block.

A left guide groove 411 and a right guide groove 412 are formed inside the block 410. A partition wall 415 is formed between the left guide groove 411 and the right guide groove 412.

In addition, a left through-hole 416 is formed at a left side of the block 410, and a right through-hole 417 is formed at a right side of the block 410.

In addition, a left magnet 413 is embedded in an inner left edge of the block 410, and a right magnet 414 is embedded in an inner right edge of the block 410.

The connector 420 includes a connector body 425 extending by a predetermined length, a left hook end 422 extending from a left edge of the connector body 425, and a right hook end 423 extending from a right edge of the connector body 425.

The left hook end 422 and the right hook end 423 extend in a direction perpendicular to the connector body 421.

The magnets 424 and 425 are embedded in the left hook end 422 and the right hook end 423, respectively.

The connector 420 is a means for connecting the two blocks 410 to each other. The left hook end 422 is inserted into the right guide groove 412 of the block 410 disposed at the left side, and the right hook end 423 is inserted into the left guide groove 411 disposed at the right side. In addition, the connector body 421 passes through the right through-hole 417 of the block 410 disposed at the left side and the left through-hole 416 of the block 410 disposed at the right side.

According to this configuration, as illustrated in FIG. 1, when the width of the storage box 10 is in the basic state, the right magnet 414 embedded in the right side of the left block 410 and the left magnet 413 embedded in the left side of the right block 410 are attached to each other by attractive force therebetween, and thus, side surfaces of the adjacent blocks 410 are maintained to be in a close contact with each other.

In this state, the hook ends 422 and 423 of the connector 420 may be spaced apart from the side surfaces of the left guide groove 411 and the right guide groove 412 and be disposed at an approximately intermediate point.

In order to increase in width of the storage box 10, when the left and right portions of the storage box 10 are pulled in a width direction, a state as illustrated in FIG. 5 is obtained.

In the state of FIG. 5, as illustrated in FIG. 7, two adjacent blocks 410 are separated from each other.

In detail, when the left hook end 422 is in close contact with a right edge of the right guide groove 412 of the left block 410, and the right hook end 423 is in close contact with the left edge of the left guide groove 411 of the right block 410, the width of the storage box 10 may maximally increase.

In addition, the number of blocks 410 separated from each other in a lateral direction may be adjusted to adjust an increase in width of the storage box 10.

Figure 8:
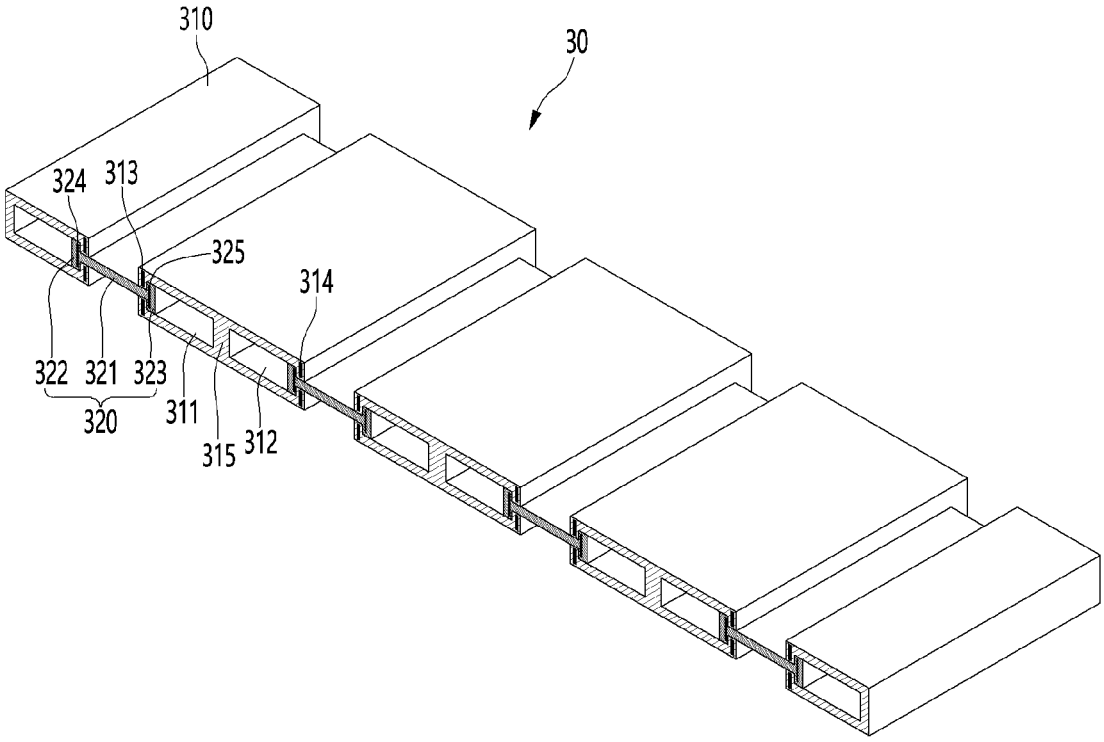
FIG. 8 is a cutaway perspective view illustrating a state in which a width of the base constituting the storage box increases according to the present invention.

FIG. 8 is a cutaway perspective view illustrating a state in which the width of the base constituting the storage box increases according to the present invention.

Referring to FIG. 8, the base 30 constituting the storage box 10 according to the embodiment of the present invention is also provided as a combination of a plurality of base blocks 310, like the first sidewalls 40.

In detail, the base 30 includes a plurality of base blocks 310 arranged in the width direction, and a plurality of connectors 320 connecting the adjacent base blocks 310 to each other.

In the base block 310, like the blocks 410 constituting the first sidewall 40, a left guide groove 311 and a right guide groove 312 are formed therein, and the connector 320 includes a connector body 321 and left and right hook ends 322 and 323 respectively extending from both ends of the connector body 321.

The left hook end 322 is accommodated in the right guide groove 312 of the left base block 310, and the right hook end 323 is accommodated in the left guide groove 312 of the right base block 310.

In addition, a left magnet 313 and a right magnet 314 are respectively embedded in inner left and right edges of the base block 310, respectively.

Also, magnets 324 and 325 are also embedded in the left hook end 322 and the right hook end 323, respectively.

Since the variation in width of the base 310 is the same as the method of varying in width of the first sidewall 40, a description thereof will be omitted.

Figure 9:
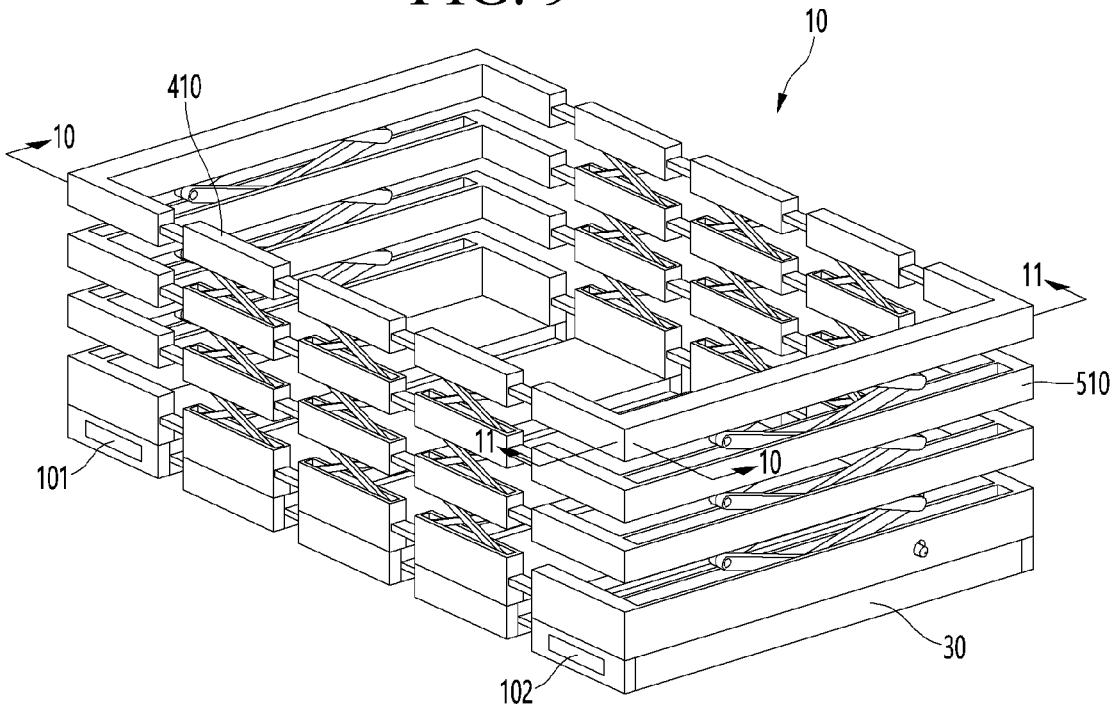
FIG. 9 is a perspective view of a state in which the storage box is adjusted in height according to an embodiment of the present invention.
Figure 10:
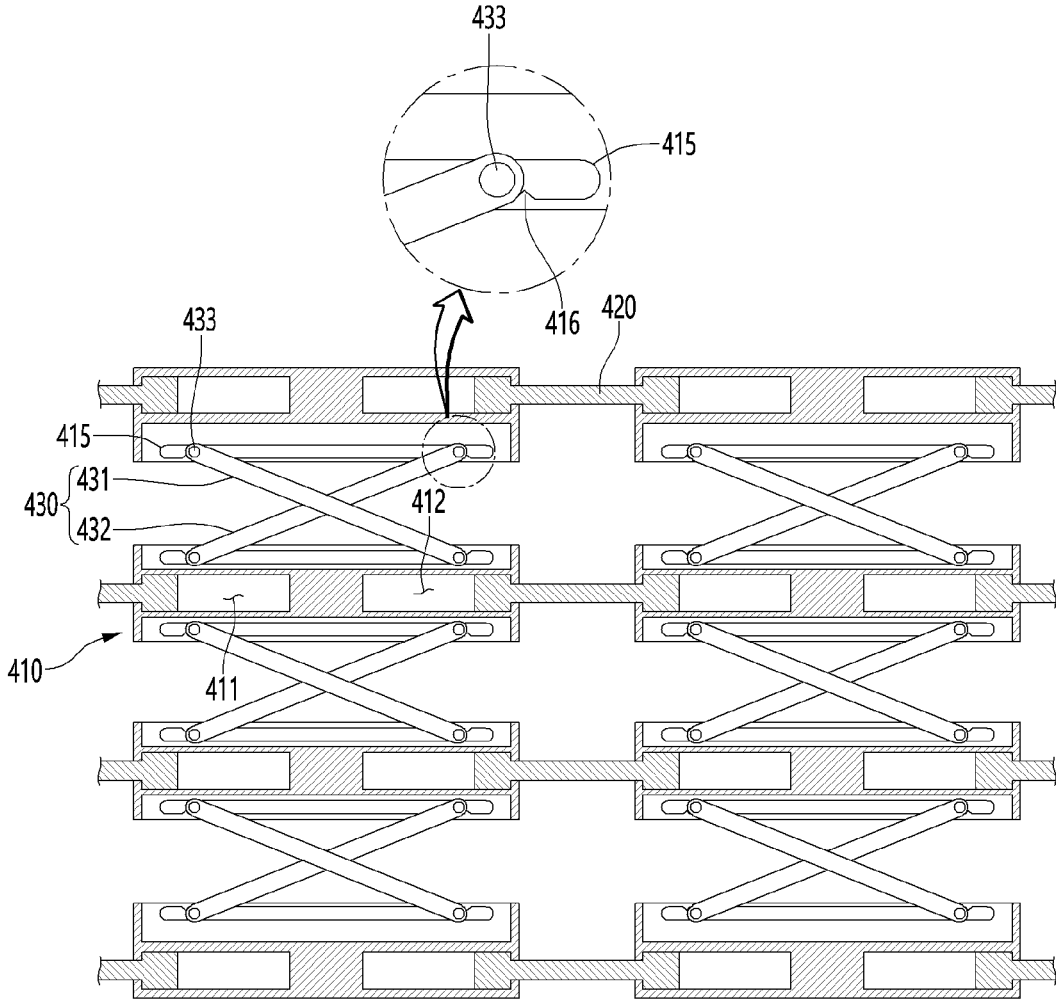
FIG. 10 is a longitudinal cross-sectional view taken along line 10-10 of FIG. 9.
Figure 11:
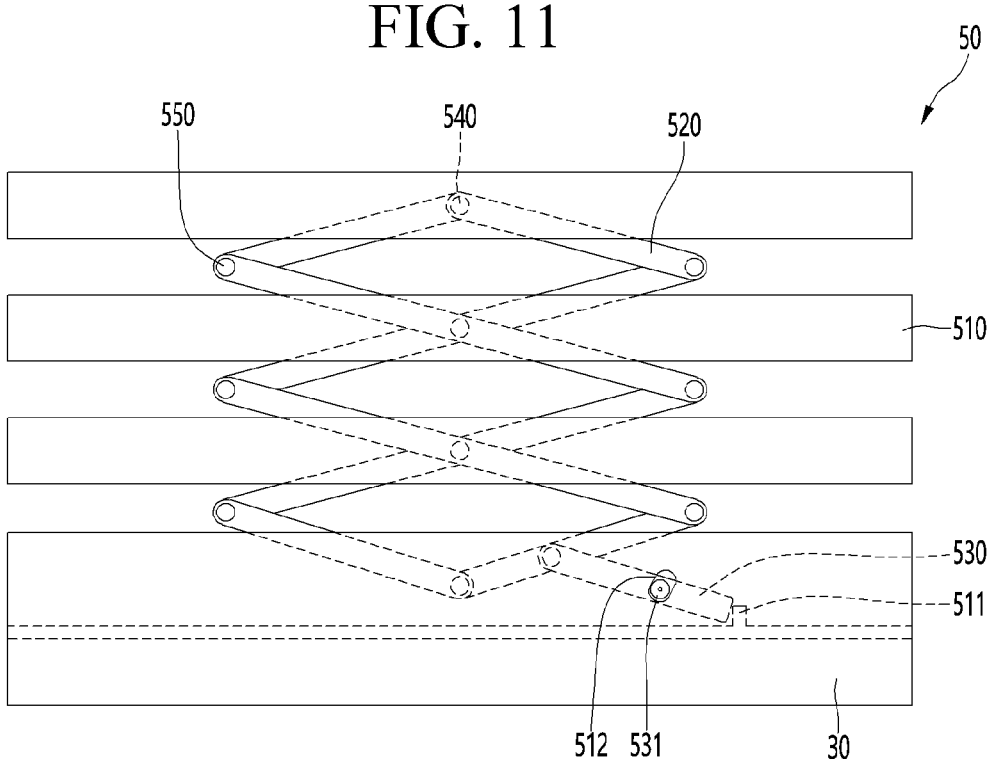
FIG. 11 is a longitudinal cross-sectional view taken along line 11-11 of FIG. 9.

FIG. 9 is a perspective view of a state in which the storage box is adjusted in height according to an embodiment of the present invention, FIG. 10 is a longitudinal cross-sectional view taken along line 10-10 of FIG. 9, and FIG. 11 is a longitudinal cross-sectional view taken along line 11-11 of FIG. 9.

Referring to FIGS. 9 and 10, the first sidewall 40 of the storage box 10 according to the present invention has a plurality of blocks 410 stacked in the vertical direction, and two blocks 410 adjacent to each other in the vertical direction are connected to each other by a link member 430.

In detail, a slide groove 414 to which an end of the link member 430 is connected is formed inside the block 410 constituting the first sidewall 40. The slide groove 414 may have a length from a left end to a right end of the block 410.

In addition, the slide groove 414 may be formed on each of front and rear surfaces of the block 410.

A bottom surface of the uppermost block 410, a top surface of the lowermost block 410, and top and bottom surfaces of the block 410 placed between the uppermost and lowermost blocks are opened and designed not to interrupt the slide of the link member 430.

In addition, the slide groove 415 may be formed at an upper side of the lowermost block 410 placed on the top surface of the base 30, and the guide grooves 411 and 412 may be formed at a lower side.

The guide grooves 411 and 412 may be formed at the upper side, and the slide groove 415 may be formed at the lower side inside the block 410 placed at the uppermost side.

In addition, the slide grooves 415 are formed at the upper and lower sides, respectively, and the guide grooves 411 and 412 may be formed between the slide grooves 415 inside the blocks 410 stacked between the uppermost block 410 and the lowermost block 410.

In addition, a plurality of restriction protrusions 416 may protrude from a bottom portion of the slide groove 415 to adjust a sliding position of the link member 430.

The link member 430 may include a first link 431 and a second link 432 that intersect in an X shape, and points at which the first link 431 and the second link 432 intersect may be connected to each other a hinge shaft.

A slide protrusion 433 may protrude from each of both ends of the first and second links 431 and 432. The slide protrusion 433 may protrude by a predetermined length from left and right sides of the links 431 and 432 and be inserted into the slide groove 415.

In addition, when a height of the storage box 10 is adjusted by an operation in which the vertically adjacent blocks 410 move away from each other or close to each other in the vertical direction, the slide protrusion 433 passes over the restriction protrusion 416 providing from the bottom of the slide groove 415.

In addition, when the vertical movement of the block 410 is stopped, the slide protrusion 433 is caught by the restriction protrusion 416 to prevent the upper block 410 from falling to the lower block 410.

Referring to FIGS. 9 and 11, the second sidewall 50 is also formed in a form in which a plurality of blocks 510 are stacked, like the first sidewall 40, and the plurality of stacked blocks 510 are connected to each other by a scissor link 520. The block 510 may be defined as a second block.

Although it is illustrated that only the height of the second sidewall 50 is adjusted in this embodiment, it is not excluded that the configuration is the same as that of the first sidewall 40.

Whether to apply the means for adjusting the length of the second sidewall 50 in the front and rear directions may be determined according to the size of the storage compartment 110*a* of the entrance refrigerator.

On the other hand, the scissor link 520, as illustrated in the drawings, is provided by connecting a plurality of link sets that intersect in an X-shape. In detail, hinge shafts 540 and 550 are inserted through a point at which two links constituting a link set intersect and both ends at which the plurality of link sets are connected to each other.

According to this structure, when a width of the scissor link 520 becomes narrow, the length of the scissor link 520 increases, and when the width increases, the length of the scissor link decreases.

In addition, the hinge shaft 540 inserted at the point at which the two links intersect is connected to the block 510, and thus, the intersection point of the link set and the block 510 is elevated as one body.

Thus, when the height of the second sidewall 50 increases while the blocks 510 adjacent to each other are spaced apart from each other, a distance between the vertically adjacent blocks 540 increases.

One end of the support 530 may be rotatably connected to the lowermost link among the plurality of links constituting the scissor link 520. In addition, a hook protrusion 511 may protrude from the bottom of the lowermost block 510 so that the other end of the support 530 is selectively hooked.

A manipulation protrusion 531 may protrude from a front surface of a support 530, and a guide hole 512 through which the manipulation protrusion 531 passes may be formed in a front surface of the lowermost block 510.

The guide hole 512 is a long hole extending in a direction inclined at a predetermined angle from a horizontal plane, and the manipulation protrusion 531 may protrude from the front surface of the lowermost block 510.

Thus, the user lowers the manipulation protrusion 531 downward in a state in which the height of the second sidewall 50 is extended, that is, in a state in which the length of the scissor link 520 increases, to allow the other end of the support 530 to be hooked with the hook protrusion 511, thereby preventing the plurality of blocks 510 from dropping downward by a load thereof.

In addition, in order to lower the second sidewall 50 to its original state, when the user pushes up the manipulation protrusion 531 so that the other end of the support 530 is released from the hook protrusion 511, each of the plurality of blocks 510 descends by its own weight to return to its original state.

Figure 12:
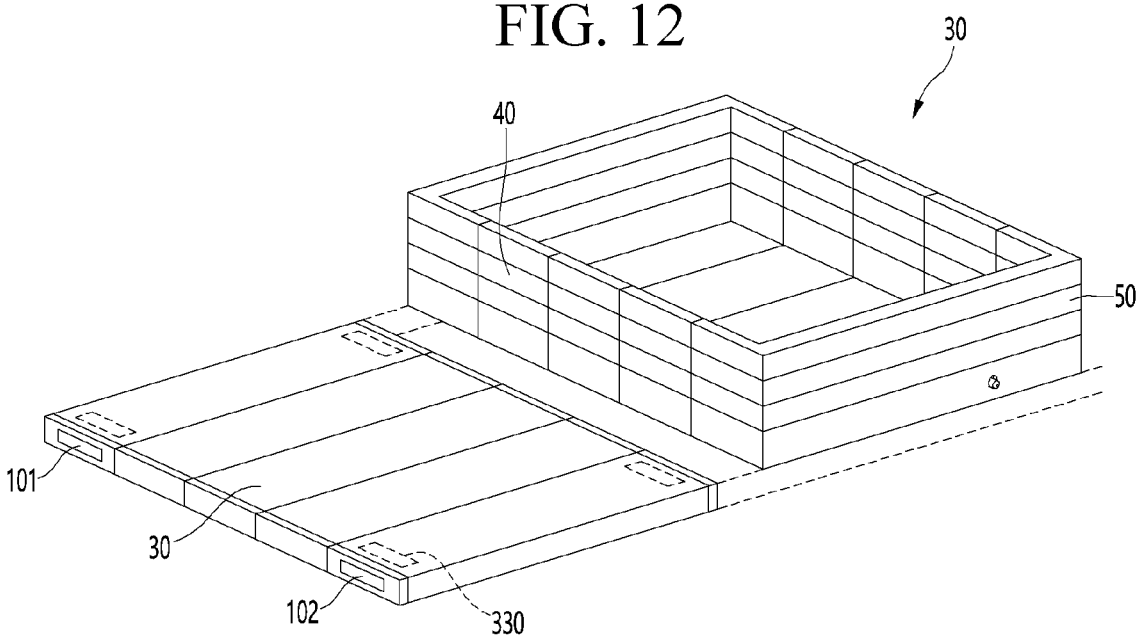
FIG. 12 is an exploded perspective view illustrating a state in which the base of the storage box is separable according to an embodiment of the present invention.

FIG. 12 is an exploded perspective view illustrating a state in which the base of the storage box is separable according to an embodiment of the present invention.

Referring to FIG. 12, the base 30 forming the bottom portion of the storage box 10 is detachable from the first and second sidewalls 40 and 50.

In detail, the order article is taken out from the entrance refrigerator 100 in a state in which the ordered article is stored in the storage box 10 to move to the kitchen refrigerator, and then the article together with the storage box 10 are accommodated in the kitchen refrigerator.

In this state, only the base 30 is slid forward to open a bottom portion of the storage box 10. Then, the stored article is directly seated on a shelf of the refrigerator.

Thereafter, when the first sidewall 40 and the second sidewall 50 are lifted upward to a height that does not interfere with the article and then taken out of the refrigerator, it is unnecessary to take out the articles stored in the storage box 10 one by one.

For this, the magnets 330 are embedded and installed in four corners of a top surface of the base 30, i.e., at fourth corners of a portion that is in contact with the lowermost first sidewall 40 or the lowermost second sidewall 50.

In addition, the magnet 460 or 560 in which the attractive force acts with the magnet 330 is mounted also inside the first side wall 40 or the second side wall 50 corresponding to the directly above the magnet 330.

Figure 13:
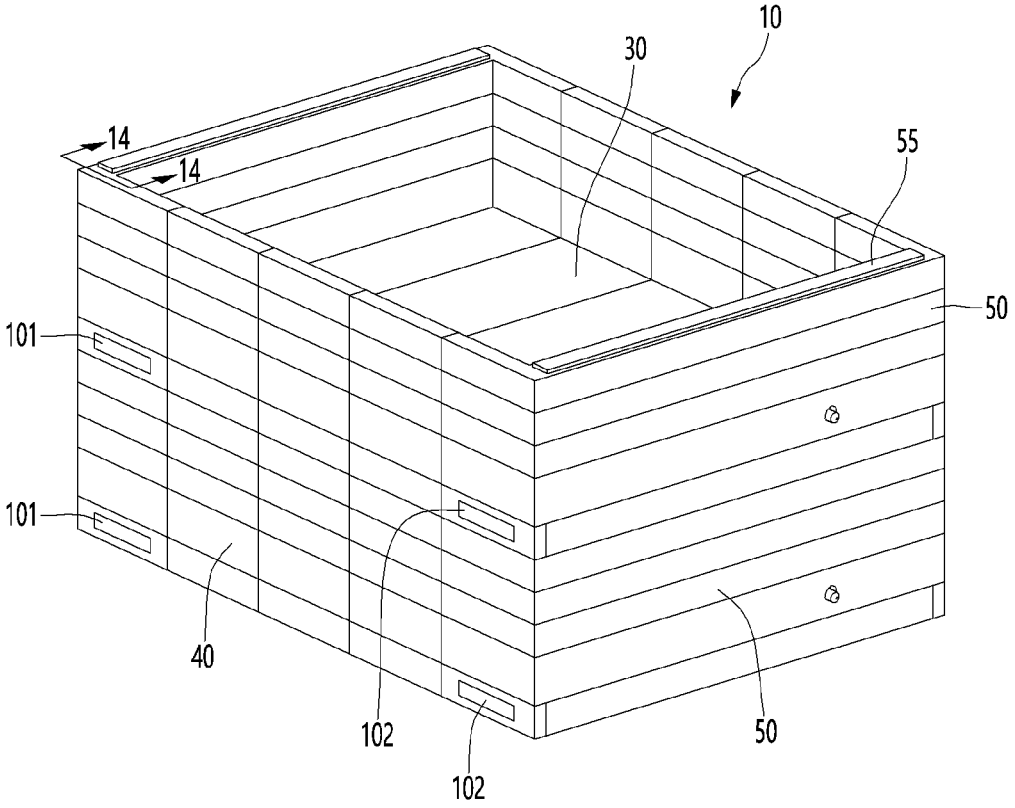
FIG. 13 is a perspective view illustrating a state in which a plurality of storage boxes are stacked.
Figure 14:
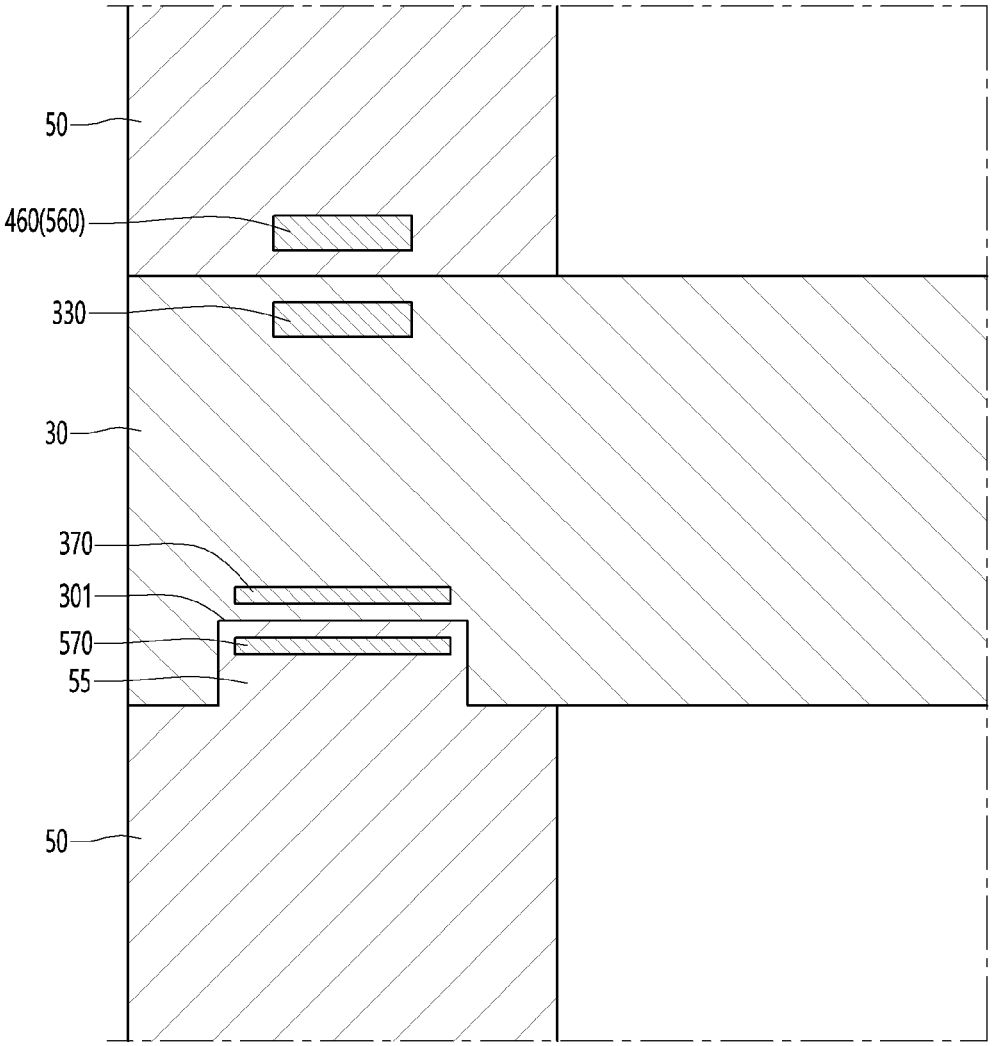
FIG. 14 is a cross-sectional view taken along line 14-14 of FIG. 13.

FIG. 13 is a perspective view illustrating a state in which a plurality of storage boxes are stacked, and FIG. 14 is a cross-sectional view taken along line 14-14 of FIG. 13.

Referring to FIGS. 13 and 14, a plurality of storage boxes 10 are capable of being stacked, and a means for preventing the stacked state of the storage boxes 10 from being easily released is proposed.

In detail, a stacking protrusion 55 may be formed on a top surface of the storage box 10.

The stacking protrusion 55 may be formed on a top surface of each of the first sidewall 40 or the second sidewall 50. Alternatively, it is also possible to be formed in all four places on the top surface of the storage box 10.

In addition, a stacking groove 301 into which the stacking protrusion 55 is fitted may be formed in an edge of the bottom surface of the base 30 of the storage box 10.

Furthermore, the magnet 570 may be embedded at an upper side of the stacking protrusion 55, and the magnet 370 may be embedded in the base 30 corresponding to the upper side of the stacking groove 301.

Then, it is possible to prevent the upper storage box from falling or drop from the storage box to the lower side by firstly coupling the protrusion to the groove, and secondly by the attractive force between the magnets 370 and 570.

The invention claimed is:

1. A storage box for a refrigerator, the storage box comprising:

a base;

a first sidewall disposed at each of a front end and a rear end of a top surface of the base; and a second sidewall disposed at each of a left end and a right end of the top surface of the base, wherein the first sidewall comprises:

a plurality of first blocks stacked in a vertical direction and arranged in a horizontal direction; and a plurality of connectors movably connecting the first blocks, which are adjacent to each other in the horizontal direction, to each other, wherein for the first blocks adjacent to each other and movably connected by a connector among the plurality of connectors, a left guide groove and a right guide groove are defined at left and right inner sides, respectively, at each first block adjacent to each other and movably connected by the connector, wherein the left guide groove and the right guide groove are partitioned by a partition wall, and a left through-hole and a right through-hole are defined in left and right surfaces, respectively, at the first block.

2. The storage box according to claim 1, wherein the connector of the plurality of connectors comprises:

a connector body extending by a predetermined length, wherein a left end of the connector body is inserted into the right through-hole of the first block on a left of the connector body and a right end of the connector body is inserted into the left through-hole of the first block on a right of the connector body, and a left hook end and a right hook end, which respectively extend from the left end and the right end of the connector body in a direction crossing the connection body, wherein the left hook end is accommodated in the right guide groove of the first block on the left of the connector body, and the right hook end is accommodated in the left guide groove of the first block on the right of the connector body.

3. The storage box according to claim 2, wherein a magnet is provided at each of a left inner edge and a right inner edge of the first blocks.

4. The storage box according to claim 2, wherein a magnet is provided inside each of the left hook end and the right hook end of the connector.

5. The storage box according to claim 1, further comprising a link member movably connecting the first blocks, which are adjacent to each other in the vertical direction, to each other.

6. The storage box according to claim 5, wherein the link member comprises a first link and a second link, which cross each other in an X shape, wherein a slide groove, into which ends of the link member are accommodated, extends in a longitudinal direction of one side of a first block among the first blocks adjacent to each other in the vertical direction, or both upper and lower sides of a first block among the first blocks adjacent to each other in the vertical direction.

7. The storage box according to claim 6, wherein a slide protrusion extending in a direction crossing the first link and the second link protrudes from each of both ends of the first link and the second link, and the slide groove is defined in each of front and rear inner surfaces of the first block among the first blocks adjacent to each other in the vertical direction.

8. The storage box according to claim 7, wherein a plurality of restriction protrusions are disposed at a bottom of the slide groove.

9. The storage box according to claim 1, wherein the second sidewall comprises:

a plurality of second blocks stacked in the vertical direction; and a scissor link movably connecting the plurality of second blocks to each other.

10. The storage box according to claim 9, wherein the scissor link comprises a plurality of link sets connected to be relatively rotatable with respect to each other, wherein each of the plurality of link sets comprises a pair of links crossing each other in an X shape, both ends of the plurality of link sets are connected to be relatively rotatable with respect to each other by a respective first hinge shaft, and the pair of links are connected to be relatively rotatable with respect to each other by a second hinge shaft at an intersection, wherein each second hinge shaft is coupled to a respective second block of the second blocks.

11. The storage box according to claim 10, further comprising:

a support having one end rotatably connected to one side of a lowermost link;

a hook protrusion protruding from a bottom of an inside of a lowermost second block so that an other end of the support is selectively hooked on the hook protrusion; and a manipulation protrusion protruding from a front surface of the support, wherein a guide hole having an elongated shape, through which the manipulation protrusion passes, is defined at the lowermost second block.

12. The storage box according to claim 1, wherein the base is detachably coupled to a bottom surface of each of the first and second sidewalls.

13. The storage box according to claim 12, wherein a magnet is provided at each of an inside of the first or second sidewall and an inside of the base, which correspond to an area that the first or second sidewall is in contact with the base.

14. The storage box according to claim 1, further comprising a stacking protrusion protruding from one side or both sides of a top surface of the first sidewall, or one side or both sides of a top surface of the second sidewall, wherein a stacking groove corresponding with the stacking protrusion defined at a bottom surface of the base.

15. The storage box according to claim 14, wherein a magnet is provided at each of:

an inside of the stacking protrusion; and an inside of the base, which corresponds to an upper side of the stacking groove.

16. The storage box according to claim 1, further comprising: at least one of:

an order information code provided at the first sidewall or the base; or a temperature display portion provided at the first sidewall or the base.

17. The storage box according to claim 1, wherein the base includes a plurality of base blocks arranged in a width direction, and a plurality of second connectors connecting the adjacent base blocks to each other.

18. The storage box according to claim 17, wherein for the base blocks adjacent to each other and movably connected by a second connector among the plurality of second connectors, a second left guide groove and a second right guide groove are defined at left and right inner sides, respectively, at each base block adjacent to each other and movably connected by the second connector, wherein the second left guide groove and the second right guide groove are partitioned by a second partition wall, and a second left through-hole and a second right through-hole are defined in left and right surfaces, respectively, at the base block.

19. The storage box according to claim 18, wherein the second connector of the plurality of second connectors comprises:

a second connector body extending by a predetermined length, wherein a left end of the second connector body is inserted into the second right through-hole of the base block on a left of the second connector body and a right end of the second connector body is inserted into the second left through-hole of the base block on a right of the second connector body, and a second left hook end and a second right hook end, which respectively extend from the left end and the right end of the second connector body in a direction crossing the second connection body, wherein the second left hook end is accommodated in the second right guide groove of the base block on the left of the second connector body, and the second right hook end is accommodated in the second left guide groove of the base block on the right of the second connector body.

20. A storage box for a refrigerator, the storage box comprising:

a base;

a first sidewall disposed at each of a front end and a rear end of a top surface of the base; and a second sidewall disposed at each of a left end and a right end of the top surface of the base, wherein the first sidewall comprises:

a plurality of first blocks stacked in a vertical direction and arranged in a horizontal direction; and a plurality of connectors movably connecting the first blocks, which are adjacent to each other in the horizontal direction, to each other, wherein the second sidewall comprises:

a plurality of second blocks stacked in the vertical direction; and a scissor link movably connecting the plurality of second blocks to each other, wherein the scissor link comprises a plurality of link sets connected to be relatively rotatable with respect to each other, wherein each of the plurality of link sets comprises a pair of links crossing each other in an X shape, both ends of the plurality of link sets are connected to be relatively rotatable with respect to each other by a respective first hinge shaft, and the pair of links are connected to be relatively rotatable with respect to each other by a second hinge shaft at an intersection, wherein each second hinge shaft is coupled to a respective second block of the second blocks, wherein the storage box further comprises:

a support having one end rotatably connected to one side of a lowermost link;

a hook protrusion protruding from a bottom of an inside of a lowermost second block so that an other end of the support is selectively hooked on the hook protrusion; and a manipulation protrusion protruding from a front surface of the support, wherein a guide hole having an elongated shape, through which the manipulation protrusion passes, is defined at the lowermost second block.

21. A storage box for a refrigerator, the storage box comprising:

a base;

a first sidewall disposed at each of a front end and a rear end of a top surface of the base; and a second sidewall disposed at each of a left end and a right end of the top surface of the base, wherein the first sidewall comprises:

a plurality of first blocks stacked in a vertical direction and arranged in a horizontal direction; and a plurality of connectors movably connecting the first blocks, which are adjacent to each other in the horizontal direction, to each other, wherein the base includes a plurality of base blocks arranged in a width direction, and a plurality of second connectors connecting the adjacent base blocks to each other, wherein for the base blocks adjacent to each other and movably connected by a second connector among the plurality of second connectors, a second left guide groove and a second right guide groove are defined at left and right inner sides, respectively, at each base block adjacent to each other and movably connected by the second connector, wherein the second left guide groove and the second right guide groove are partitioned by a second partition wall, and a second left through-hole and a second right through-hole are defined in left and right surfaces, respectively, at the base block.

22. The storage box according to claim 21, wherein the second connector of the plurality of second connectors comprises:

a second connector body extending by a predetermined length, wherein a left end of the second connector body is inserted into the second right through-hole of the base block on a left of the second connector body and a right end of the second connector body is inserted into the second left through-hole of the base block on a right of the second connector body, and a second left hook end and a second right hook end, which respectively extend from the left end and the right end of the second connector body in a direction crossing the second connection body, wherein the second left hook end is accommodated in the second right guide groove of the base block on the left of the second connector body, and the second right hook end is accommodated in the second left guide groove of the base block on the right of the second connector body.

* * * * *